US005266166A

United States Patent [19]

Dreisbach et al.

[11] Patent Number: 5,266,166

[45] Date of Patent: Nov. 30, 1993

[54] METHODS FOR CONTROLLING THE DEPOSITION OF ORGANIC CONTAMINANTS IN PULP AND PAPERMAKING PROCESSES USING A POLYALKYLENE OXIDE/VINYL ACETATE GRAFT COPOLYMER

[75] Inventors: David D. Dreisbach; Iris D. Barton, both of Jacksonville, Fla.

[73] Assignee: Betz PaperChem, Inc., Jacksonville, Fla.

[21] Appl. No.: 884,669

[22] Filed: May 18, 1992

[51] Int. Cl.[5] ..... D21H 21/02; D21C 9/08

[52] U.S. Cl. ..... 162/199; 162/5; 162/168.1; 162/DIG. 4

[58] Field of Search ..... 162/199, DIG. 4, 5, 162/168.1, 164.1, 164.7

[56] References Cited

U.S. PATENT DOCUMENTS

| | | | |
|---|---|---|---|
| 3,748,220 | 7/1973 | Gard | 162/72 |
| 3,992,249 | 11/1976 | Farley | 162/72 |
| 4,190,491 | 2/1980 | Drennan et al. | 162/76 |
| 4,313,790 | 2/1982 | Pelton et al. | 162/DIG. 4 |
| 4,608,123 | 8/1986 | Leahy | 162/146 |
| 4,744,865 | 5/1988 | Dreisbach et al. | 162/168.1 |
| 4,746,456 | 5/1988 | Kud et al. | 252/174.24 |
| 4,765,867 | 8/1988 | Dreisbach et al. | 162/72 |
| 4,846,933 | 7/1989 | Dreisbach et al. | 162/168.1 |
| 4,871,424 | 10/1989 | Dreisbach et al. | 162/199 |
| 4,995,944 | 2/1991 | Aston et al. | 162/DIG. 4 |
| 5,074,961 | 12/1991 | Dreisbach et al. | 162/199 |

FOREIGN PATENT DOCUMENTS

| | | | |
|---|---|---|---|
| 0358474 | 9/1988 | European Pat. Off. . | |
| 48201 | 4/1975 | Japan | 162/DIG. 4 |

*Primary Examiner*—Karen M. Hastings

*Attorney, Agent, or Firm*—Alexander D. Ricci; Philip H. Von Neida

[57] ABSTRACT

Methods for inhibiting deposition of organic contaminants from pulp in pulp and papermaking systems which comprises treating the pulp and papermaking system with an effective amount of a polyalkylene oxide/vinyl acetate graft copolymer.

15 Claims, No Drawings

METHODS FOR CONTROLLING THE DEPOSITION OF ORGANIC CONTAMINANTS IN PULP AND PAPERMAKING PROCESSES USING A POLYALKYLENE OXIDE/VINYL ACETATE GRAFT COPOLYMER

FIELD OF THE INVENTION

The present invention relates to methods for inhibiting the deposition of organic contaminants from pulp in pulp and papermaking systems.

BACKGROUND OF THE INVENTION

The deposition of organic contaminants in the pulp and paper industry can cause both quality and efficiency problems in pulp and papermaking systems. Some components occur naturally in wood and are released during various pulping and papermaking processes. The term "pitch" can be used to refer to deposits composed of organic constituents which may originate from these natural resins, their salts, as well as coating binders, sizing agents, and defoaming chemicals which may be found in the pulp. In addition, pitch frequently contains inorganic components such as calcium carbonate, talc, clays, titanium, and related materials.

Stickies is a term that has become increasingly used to describe deposits that occur in systems using recycled fiber. These deposits often contain the same material found in "pitch" deposits in addition to adhesives, hot melts, waxes, and inks. All of the aforementioned materials have many common characteristics including: hydrophobicity, deformability, tackiness, low surface energy, and the potential to cause problems with deposition, quality, and efficiency in the process. Diagram 1 shows the complex relationship between pitch and stickies discussed here.

Diagram 1

| | Pitch | Stickies |
|---|---|---|
| Natural Resins (fatty and resin acids, fatty esters, insoluble salts, sterols, etc.) | X | X |
| Defoamers (oil, EBS, silicate, silicone oils, ethoxylated compounds, etc.) | X | X |
| Sizing Agents (Rosin size, ASA, AKD, hydrolysis products insoluble salts, etc.) | X | X |
| Coating Binders (PVAC, SBR) | X | X |
| Waxes | | X |
| Inks | | X |
| Hot Melts, (EVA, PVAC, etc.) | | X |
| Contact Adhesives (SBR, vinyl acrylates, polysisoprene, etc.) | | X |

The deposition of organic contaminants can be detrimental to the efficiency of a pulp or paper mill causing both reduced quality and reduced operating efficiency. Organic contaminants can deposit on process equipment in papermaking systems resulting in operational difficulties in the systems. The deposition of organic contaminants on consistency regulators and other instrument probes can render these components useless. Deposits on screens can reduce throughput and upset operation of the system. This deposition can occur not only on metal surfaces in the system, but also on plastic and synthetic surfaces such as machine wires, felts, foils, Uhle boxes and headbox components.

Historically, the subsets of the organic deposit problems, "pitch" and "stickies" have manifested themselves separately, differently and have been treated distinctly and separately. From a physical standpoint, "pitch" deposits have usually formed from microscopic particles of adhesive material (natural or man-made) in the stock which accumulate on papermaking or pulping equipment. These deposits can readily be found on stock chest walls, paper machine foils, Uhle boxes, paper machine wires, wet press felts, dryer felts, dryer cans, and calendar stacks. The difficulties related to these deposits included direct interference with the efficiency of the contaminated surface, therefore, reduced production, as well as holes, dirt, and other sheet defects that reduce the quality and usefulness of the paper for operations that follow like coating, converting, or printing.

From a physical standpoint, "stickies" have usually been particles of visible or nearly visible size in the stock which originate from the recycled fiber. These deposits tend to accumulate on many of the same surfaces that "pitch" can be found on and causes many of the same difficulties that "pitch" can cause. The most severe "stickies" related deposits however tend to be found on paper machine wires, wet felts, dryer felts, and dryer cans.

Methods of preventing the build up of deposits on the pulp and papermill equipment and surfaces are of great importance to the industry. The paper machines could be shut down for cleaning, but ceasing operation for cleaning is undesirable because of the consequential loss of productivity, poor quality while partially contaminated and "dirt" which occurs when deposits break off and become incorporated in the sheet. Preventing deposition is thus greatly preferred where it can be effectively practiced.

In the past stickies deposits and pitch deposits have typically manifested themselves in different systems. This was true because mills usually used only virgin fiber or only recycled fiber. Often very different treatment chemicals and strategies were used to control these separate problems.

Current trends are for increased mandatory use of recycled fiber in all systems. This is resulting in a co-occurance of stickies and pitch problems in a given mill. It is desirable to find treatment chemicals and strategies which will be highly effective at eliminating both of these problems without having to feed two or more separate chemicals. The materials of this invention have clearly shown their ability to achieve this goal.

Pitch control agents of commerce have historically included surfactants, which when added to the system, can stabilize the dispersion of the pitch in the furnish and white water. Stabilization can help prevent the pitch from precipitating out on wires and felts.

Mineral additives such as talc have also found use and can reduce the tacky nature of pitch by adsorbing finely dispersed pitch particles on their surfaces. This will reduce the degree to which the particles coagulate or agglomerate.

Polyphosphates have been used to try to maintain the pitch in a finely dispersed state. Alum has also been widely used to reduce deposition of pitch and related problems.

Both chemical and non-chemical approaches to stickies control are employed in papermaking. Non-chemical approaches include furnish selection, screening and cleaning, and thermal/mechanical dispersion units.

Chemical treatment techniques for stickies control include dispersion, detackification, wire passivation and cationic fixation. Chemicals used included talc, polymers, dispersants and surfactants.

SUMMARY OF THE INVENTION

The present invention pertains to methods for inhibiting the deposition of organic contaminants from pulp in pulp and papermaking systems comprising treating said systems with an effective amount for the purpose of a polyalkylene oxide/vinylacetate graft copolymer.

Common organic contaminants include constituents which occur in the pulp (virgin, recycled or combinations) having the potential to deposit and reduce paper machine performance or paper quality. This will include natural resins such as fatty acids, resin acids, their insoluble salts, fatty esters, sterols and other organic constituents, like ethylene bis-stearamide, waxes, sizing agents, adhesives, hot melts, inks, defoamers, and latexes that may be found to deposit in papermaking systems.

DESCRIPTION OF THE RELATED ART

U.S. Pat. No. 3,748,220, Gard, July 1973 discloses methods for stabilizing pitch in papermaking pulp. The methods comprise adding to the pulp an aqueous solution of nitrilotriacetic acid sodium salt and a water soluble acrylic polymer, such as polyacrylic acid.

U.S. Pat. No. 3,992,249, Farley, November 1976 teaches using an aqueous solution of an anionic polymer containing hydrophobic-oleophilic linkages and hydrophilic acid linkages in pulp making system. These polymers are used to inhibit pitch deposition in these systems.

U.S. Pat. No. 4,190,491, Drennan et al., February 1980 teaches controlling pitch using a water-soluble linear cationic polymer. The polymers can contain vinyl acetate groups.

U.S. Pat. No. 4,608,123, Leahy, August 1986 teaches inhibiting the untoward effects of pitch on paper and papermaking equipment. This method employs adding a polyolefin pulp such as polyethylene pulp to the cellulosic pulp.

U.S. Pat. No. 4,744,865, Dreisbach et al., May 1988 discloses inhibiting pitch deposition from pulp using a polymer derived from vinyl alcohol having methyl ether groups pendant to the backbone of the polymer.

U.S. Pat. No. 4,746,456, Kud et al., May 1988 teaches using the graft copolymers discussed in the present invention as anti-redeposition agents in laundry detergents. The copolymers are used as part of a detergent composition including surfactants, builders, bleaches and conventional additives.

U.S. Pat. No. 4,765,867 Dreisbach et al., August 1988 teaches using a water-soluble quaternized polyamine ionene polymer to inhibit pitch deposition from pulp.

U.S. Pat. No. 4,846,933, Dreisbach et al., July 1989 teaches pitch control using a polymer containing polymerized units of methyl vinyl ether having methyl ether groups.

DETAILED DESCRIPTION OF THE INVENTION

The present inventors have discovered that pitch deposition from pulp in papermaking systems can be inhibited by adding an effective pitch-inhibiting amount of a poly alkylene oxide/vinyl acetate graft copolymer to the process.

The molecular weight of these polymers can vary over a wide range. They may be obtained by grafting a polyalkylene oxide of molecular weight (number average) 2000 to 100,000 with vinyl acetate, which may be partially saponified, in a weight ratio of polyalkylene oxide to vinyl acetate of 1:0.2 to 1:10. Preferably, the molecular weight of the polyalkylene oxide is 4000 to 50,000 and more. Preferably, from 2000 to 50,000 and having weight ratio of polyalkylene oxide to vinyl acetate of from 1:0.5 to 1:6.

One method of making the polymers of the present invention is described in European Patent Application EP 0 358 474 AZ, which is wholly incorporated by reference herein. In one embodiment, the grafting procedure may be performed using vinyl acetate saponified up to 15%. The polyalkylene oxide may contain units of ethylene oxide, propylene oxide and/or butylene oxide with polyethylene oxide preferred.

In the preferred embodiment, a material within this definition is based on a polyethylene oxide of molecular weight 6000. This polymer contains approximately 3 parts by weight of vinyl acetate units per 1 part by weight of polyethylene oxide. This polymer has a molecular weight of 24,000 and is commercially available from BASF as Sokalan ® HP22.

The polymers of the instant invention are effective at controlling the deposition of organic contaminants in papermaking systems. This may include Kraft, acid sulfite, mechanical pulp and recycled fiber systems. For example, deposition in the brown stock washer, screen room and decker system in Kraft papermaking processes can be controlled. The term "papermaking system" is meant to include all pulp processes. Generally, it is thought that these polymers can be utilized to prevent deposition on all surfaces from the pulp mill to the reel of the paper machine under a variety of pH's and conditions. More specifically, these polymers effectively decrease the deposition not only on metal surfaces but also on plastic and synthetic surfaces such as machine wires, felt, foils, Uhle boxes and headbox components.

The polymers may be added to the papermaking system along with other papermaking additives. These can include other polymers, starch and sizing aids.

The polymers of the present invention can be added to the system at any stage of the papermaking system. They may be added directly to the pulp furnish or sprayed on wires, felts, press rolls or other deposition-prone surfaces. They may be added to the papermaking system neat, as a powder, slurry or in solution; the preferred primary solvent being water but is not limited to such. They may be added specifically and only to a furnish identified as contaminated or may be added to blended pulps. The polymers may be added to the stock at any point prior to the manifestation of the deposition problem and at more than one site when more than one deposition site occurs. Combinations of the above additive methods may also be employed by way of feeding the pulp millstock, feeding to the papermachine furnish, and spraying on the wire and felt simultaneously. The effective amount of these polymers to be added to the papermaking system depends on a number of variables, including the pH of the system, hardness of the water, temperature of the water, additional additives, and the organic contaminant type and content of the pulp. Generally, 0.5 parts per million to about 150 parts per million parts pulp is added to the paper making system. Preferably, from about 10 parts per million to about 50 parts per million parts pulp is added to the system.

There are several advantages anticipated with the present invention as compared to prior processes. These advantages include: an ability to function without being greatly affected by hardness of the water in the system; an ability to function with lower foaming than surfactants, an ability to function while not adversely affecting sizing, fines retention, and an ability to function at very low dosages, reduced environmental impact, and improved biodegradability. Also, the ability of these agents to function in a non-retaining manner relative to certain recent prior art.

Further these agents have proven effective against both the pitch and stickies manifestation of organic deposition problems providing for an effective reduction of these problems in mills employing a variety of virgin and recycled fiber sources.

The data set forth below were developed to demonstrate the unexpected results occasioned by use of the invention. The following examples are included as being illustrations of the invention and should not be construed as limiting the scope thereof.

DETAILED DESCRIPTION OF THE PREFERRED EMBODIMENT

Pitch was made to deposit from a 0.5% consistency fiber slurry containing 2000 parts per million pitch by placing the slurry into a metal pan suspended in an ultrasonic cleaner water bath.

This slurry contained 0.5% bleached hardwood Kraft fiber, approximately 2000 parts per million of a mixed fatty acid blend as the potassium salt, approximately 200 parts per million calcium from calcium chloride and approximately 300 parts per million sodium carbonate.

This slurry was maintained at 50° C. and a pH of 11.0. It was stirred gently by an overhead stirrer and subjected to ultrasonic energy for 10 minutes. The amount of pitch deposition was determined by subtracting the weight of the metal pan from the oven dried weight of the pan plus deposit. A high percent reduction shows efficacious pitch deposition inhibition. The results of this testing are presented in Table I.

TABLE I

Reduction in Deposit Weight in Pitch Deposition Test

| Treatment Agent | % Reduction 100 ppm | 50 ppm | 10 ppm |
|---|---|---|---|
| Control | | 0 | 0 |
| Nonylphenol Ethoxylate Surfactant[1] | | 88 | 11 |
| Hydrolyzed Styrene Maleic Anhydride[2] | 78 | 0 | 0 |
| Sodium Lignosulfonate[3] | | 8 | 0 |
| PO/VA Copolymer[4] | | 93 | 55 |
| PO/VA Copolymer[5] | | 95 | 34 |
| PO/VA Copolymer[6] | | 92 | 29 |
| PO/VA Copolymer[7] | | 95 | 64 |
| PO/VA Copolymer[8] | | 96 | 63 |

[1]available as Surfonic ® N-95 commercial pitch control agent
[2]available as Alco SMA 1000 as described in U.S. 3,992,249
[3]available as Lignosol ® XD commerical pitch control agent
[4]available as Sokalan ® HP-22, MW = 6,000 1 part polyethylene oxide with 3 parts vinyl acetate by weight
[5]similar to HP-22 except lower molecular weight and lower cloud point
[6]similar to HP-22 except lower molecular weight and lower cloud point
[7]similar to HP-22 except higher molecular weight and higher cloud point
[8]similar to HP-22 except higher molecular weight and higher cloud point
PO/VA = polyethylene oxide/vinyl acetate graft copolymer The results shown in Table I demonstrate that copolymers in accordance with this invention are effective in controlling pitch deposits from pulp in a test designed to simulate brown stock washer/screen from Kraft pitch deposition. More broadly, these results indicate that the polymers are effective in controlling pitch deposition.

Further testing was performed to evaluate the graft copolymers of the instant invention at controlling pitch aggregation. A laboratory colloidal pitch system was treated with various treatments then allowed to incubate in a waterbath. A turbidity measurement is made on the sample, then the sample is passed through a coarse filter paper. A turbidity measurement is then made on the filtrate.

Systems displaying no difference in the turbidity between the original sample and the filtrate prove to be effective pitch aggregation control treatments. Samples with an aggregation tendency display large differences in turbidity between the original sample and the filtrate. This indicates substantial retention of the pitch by the filter paper. The results of this testing appear in Tables II and III.

TABLE II

Pitch Aggregation Testing pH = 7

| Treatment | Aggregation (Δ Turbidity) 70° C. | 50° C. | 25° C |
|---|---|---|---|
| Control | 596 | 627 | 398 |
| A | 358 | 116 | 154 |
| B | 489 | 255 | 188 |
| C | 20 | 91 | 122 |

A is polyvinyl alcohol
B is hydroxypropylmethylcellulose
C is a polyalkylene oxide/vinyl acetate graft copolymer available as Sokalan ® HP-22

TABLE III

Pitch Aggregation Testing pH = 4

| Treatment | Aggregation (Δ Turbidity) 70° C. | 50° C. | 25° C. | 70° Surface Scum |
|---|---|---|---|---|
| Control | 278 | 657 | 434 | Yes |
| A | 333 | 120 | 197 | Yes |
| B | 677 | 305 | 114 | Yes |
| C | 139 | 333 | 147 | Yes |

A is polyvinyl alcohol
B is hydroxypropylmethylcellulose
C is a polyalkylene oxide/vinyl acetate graft copolymer available as Sokalan ® HP-22

The alkylene oxide/vinyl acetate graft copolymers of the instant invention proved more effective at controlling pitch aggregation than certain of the known art. This proved most obvious at pH of 7 which is more like the pH experienced in brownstock washers and the extraction stage of bleach plants. The acidic conditions of pH of 4 are less likely to present pitch aggregation problems in the bleach plant.

In order to establish the efficacy of the materials of this invention as deposition control agents, on plastic surfaces and specifically for adhesive contaminants of the sort found in recycled fiber, a laboratory test was devised utilizing adhesive-backed tapes as stickie coupons. The stickie coupon can be fabricated from any type of adhesive tape that will not disintegrate when placed in water. For the study, tapes made from a styrenebutadiene rubber and vinylic esters were used. Both of these potential organic contaminants are known to cause problems "stickies" in secondary fiber utilization. A second coupon was fabricated from polyester film such as the product marketed as MYLAR by the DuPont Chemical Company. This material was chosen because papermachine forming fabrics are frequently made of polyester which is susceptible to considerable problem caused by stickies.

500 mL of solutions in 600 mL beakers containing various deposit control agents are placed in a water bath heated to 50° C. The tape and the polyester film coupons are placed in the test solution so the adhesive side of the coupon faces away from the polyester film coupon. After 1 hour of immersion, the adhesive side of the stickie coupon is placed in contact with the polyester coupon and pressed to 1000 pound force.

The average peel strength of the bond formed between the tape coupon and the polyester coupon was measured with an Instron tensile tester. The peel strength of the bond formed between the stickie tape coupon and the polyester coupon was interpreted as a measure of the tendency for an organic contaminant to attach to components of a paper-machine and cause runnability or product quality problems. More specifically, this indicates the tendency of a stickies deposit to form on a plastic surface. These results are reported in Table IV.

TABLE IV

| | Adhesion Testing Results | |
|---|---|---|
| | % Control in Adhesion Test | |
| Treatment | 10 ppm | 2 ppm |
| A | 80 | 65 |
| B | 98 | 66 |
| C | 98 | 41 |
| D | 98 | 74 |
| E | 98 | 59 |

A is available as Sokalan ® HP-22, MW = 6,000 1 part polyethylene oxide with 3 parts vinyl acetate by weight
B is similar to HP-22 except lower molecular weight and lower cloud point
C is similar to HP-22 except lower molecular weight and lower cloud point
D is similar to HP-22 except higher molecular weight and higher cloud point
E is similar to HP-22 except higher molecular weight and higher cloud point While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention what we claim is:

1. A method for inhibiting the deposition of organic contaminants from pulp in pulp and papermaking systems comprising treating said pulp and papermaking systems with an effective amount for the purpose of a polyalkylene oxide/vinyl acetate graft copolymer wherein the vinylacetate is saponified up to 15%, wherein said copolymer is derived by grafting a polyalkylene oxide of molecular weight number average of 2000 to 100,000 with vinyl acetate in a weight ratio of polyalkylene oxide to vinyl acetate of 1:0.2 to 1:10.

2. The method as claimed in claim 1 wherein said graft copolymer contains a 3:1 ratio by weight of vinyl acetate to ethylene oxide wherein the acetate is saponified up to 15%.

3. The method as claimed in claim 1 wherein said polyalkylene oxide is selected from the group consisting of polyethylene oxide, polypropylene oxide and polybutylene oxide.

4. The method as claimed in claim 1 wherein said copolymer is derived from grafting a polyalkylene oxide of molecular weight number average of 4000 to 50,000 with vinyl acetate in a weight ratio of polyalkylene oxide to vinyl acetate of 1:0.5 to 1:6.

5. The method as claimed in claim 1 wherein said copolymer has a molecular weight of 24,000.

6. The method as claimed in claim 5 wherein said copolymer contains approximately 3 parts by weight of vinyl acetate units per 1 part by weight of polyethylene oxide.

7. The method as claimed in claim 1 wherein said graft copolymer is sprayed directly into said pulp and papermaking system.

8. The method as claimed in claim 1 wherein said copolymer is delivered to said pulp and papermaking systems in a carrier solvent.

9. The method as claimed in claim 1 wherein said copolymer is delivered to said pulp and papermaking systems as a powder or a slurry.

10. The method as claimed in claim 9 wherein said carrier solvent is water.

11. The method as claimed in claim 1 wherein said copolymer is added to said pulp and papermaking systems by spraying.

12. The method as claimed in claim 1 wherein said copolymer is added to said pulp and papermaking systems with other papermaking treatments.

13. The method as claimed in claim 1 wherein said organic contaminants are pitch deposits.

14. The method as claimed in claim 1 wherein said organic contaminants are stickies deposits.

15. The method as claimed in claim 1 wherein said organic contaminants are a mixture of pitch deposits and stickies deposits.

* * * * *